US007258419B2

(12) United States Patent
Lim

(10) Patent No.: US 7,258,419 B2
(45) Date of Patent: Aug. 21, 2007

(54) INK JET PRINTER WITH IMPROVED PRINT HEAD CLEANING APPARATUS AND METHOD OF OPERATING THE SAME

(75) Inventor: Gui-Taek Lim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 341 days.

(21) Appl. No.: 10/962,446

(22) Filed: Oct. 13, 2004

(65) Prior Publication Data

US 2005/0146553 A1 Jul. 7, 2005

(30) Foreign Application Priority Data

Jan. 5, 2004 (KR) ..... 10-2004-0000437

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS 5,937,250 A 8/1999 Kwak et al.
5,997,128 A * 12/1999 Lou et al. ..... 347/33
6,132,026 A * 10/2000 Taylor et al. ..... 347/32
6,598,955 B1 * 7/2003 Tee et al. ..... 347/33
6,719,401 B2 * 4/2004 Takahashi ..... 347/33

FOREIGN PATENT DOCUMENTS

| | | |
|---|---|---|
| JP | P62-288047 | 12/1987 |
| JP | P06-270414 | 9/1994 |
| JP | 2001-018407 | 1/2001 |
| KR | 1001621910000 | 8/1998 |
| KR | 1999-018088 | 3/1999 |

* cited by examiner

*Primary Examiner*—Stephen Meier
*Assistant Examiner*—Rene Garcia, Jr.
(74) *Attorney, Agent, or Firm*—Roylance, Abrams, Berdo & Goodman, L.L.P.

(57) ABSTRACT

An ink jet printer having an improved print head cleaning apparatus includes an ink cartridge provided with a print head on a lower portion thereof and performs a linear reciprocating movement in a predetermined direction by means of a carriage. A housing is disposed below a lower side of the carriage. A wiper is provided in the housing and cleans the print head in contact with the print head. A wiper variable position unit moves the wiper to change a contact position between the print head and the wiper.

19 Claims, 5 Drawing Sheets

INK JET PRINTER WITH IMPROVED PRINT HEAD CLEANING APPARATUS AND METHOD OF OPERATING THE SAME

CROSS-REFERENCE TO RELATED APPLICATION

This application claims benefit under 35 U.S.C. §119(a) of Korean Patent Application No. 2004-437, filed on Jan. 5, 2004, the entire contents of which are hereby incorporated by reference.

BACKGROUND OF THE INVENTION

1. Field of the Invention

The present invention relates to an ink jet printer with an improved print head cleaning apparatus and method of operating the same. More particularly, the present invention relates to an ink jet printer with an improved print head cleaning apparatus and method of operating the same, in which a contact position between a print head and a wiper is periodically changed, thereby preventing abrasion of the wiper and enhancing a wiping effect of the wiper.

2. Description of the Related Art

As a general rule, ink jet printers are designed so that a carriage with an ink cartridge is movably installed to a main frame. The carriage is reciprocated by a moving unit, with support on a timing belt and a guide shaft.

The ink cartridge is provided with a print head on a lower side thereof. The print head sprays ink on printing paper fed by a feeding roller, thereby generating an image. The print head sprays the ink on one side of the printing paper through an injection nozzle, and thus the ink transferred into the printing paper forms an image. Operation of spraying the ink through the injection nozzle is appropriately controlled according to image information received at a controller of the printer.

After printing, residual ink is found in the injection nozzle. Sometimes, especially after the printer has been idle for a long time, the residual ink in the injection nozzle becomes solidified. In this case, the injection nozzle is entirely or partly clogged by the solidified ink. As a result, a proper amount of ink is not sprayed during printing, which results in poor print quality.

The ink injection nozzle may be clogged by the ink as well as by a foreign material such as dust. Dust will also negatively affect print quality. Therefore, to prevent the ink injection nozzle from being clogged, a device for cleaning the print head is required.

Such a print head cleaning apparatus is disclosed in Japan Patent Publication No. 2001-18407 (publication date: Jan. 23, 2001; title: INK JET PRINTER), the entire contents of which are incorporated herein by reference.

As for its configuration, a nozzle head wiper holding member is mounted to a wiper carrier capable of reciprocating in the main scanning direction of a nozzle head in such a manner that the nozzle head wiper holding member can be vertically moved through a predetermined range. A spring for upwardly urging the nozzle head wiper holding member is provided between the wiper carrier and the nozzle head wiper holding member. Both elastically deformable nozzle head wipers, and a wiper contact angle adjusting roller rotatably engaged with the nozzle head side are attached to the nozzle head wiper holding member. The nozzle head is capable of being wiped by holding a contact angle of each of the nozzle head wipers with respect to the lower surface of the nozzle head to a constant level.

One example of the conventional print head cleaning apparatus is shown in FIG. 1. As shown, the device includes a housing 10 installed on the lower side of a cartridge 1, a plate 11 slidably mounted in the housing 10, and a wiper 13 vertically provided on the plate 11. The wiper 13 cleans a print head of the ink cartridge at a home position while it is reciprocated by the plate 11.

The conventional print head cleaning apparatus brings the print head into contact with the wiper at a single position at all times. For this reason, the wiper is subjected to concentrated abrasion at only that single position, thus decreasing wiping efficiency.

SUMMARY OF THE INVENTION

It is, therefore, an objective of the present invention to provide an ink jet printer with an improved print head cleaning apparatus, capable of changing a contact position with a print head by periodically moving a wiper which performs cleaning in contact with the print head.

In order to accomplish this objective, according to an aspect of the present invention, there is provided an ink jet printer having an improved print head cleaning apparatus. The ink jet printer comprises an ink cartridge provided with a print head on a lower portion thereof and reciprocating in a predetermined direction by means of a carriage, a housing provided on a lower side of the carriage, a wiper provided in the housing and cleaning the print head in contact with the print head, and a wiper variable position unit moving the wiper so as to change a contact position between the print head and the wiper.

The wiper variable position unit according to an embodiment of the present invention comprises a movable plate reciprocating in a direction substantially perpendicular to a motion direction of the carriage, a wiper slider supporting the wiper on an upper surface thereof and provided on one side of the movable plate and moving along the motion direction of the carriage, and a slider transfer unit moving the wiper slider.

The slider transfer unit according to an embodiment of the present invention comprises a first elastic member, a rack, a stopper and a moving unit. The first elastic member is provided to exert an attraction force on the slider transfer unit with one end connected to one side of the wiper slider and with the other end connected to one side of the movable plate. The rack is formed on a bottom surface of the wiper slider. The stopper is rotatably hinged on one side of the housing, having one end caught onto the rack, and coupled to exert a repulsive force on the rack via a second elastic member. The moving unit releases the stopper from the rack.

The first elastic member preferably is a tension coil spring.

The moving unit according to an embodiment of the present invention comprises an actuating bar integrally extending from the stopper, and an actuator forcing the stopper to be momentarily released from the rack in contact with the actuating bar, wherein the actuator is a solenoid shaft.

According to another aspect of the present invention, there is provided a method for operating an ink jet printer having an improved print head cleaning apparatus. The method of operating an ink jet printer comprises moving an ink cartridge provided with a print head in a linear reciprocating manner in a predetermined direction, cleaning the print head by wiping a wiper in contact with the printhead in a direction perpendicular to the predetermined direction, and moving the wiper so as to change a contact position between the print head and the wiper.

The step of moving the wiper so as to change the contact position between the print head and the wiper according to another embodiment of the present invention comprises moving the wiper by a wiper variable position unit. Furthermore, the step of moving the wiper further comprises moving the wiper in a direction parallel to the predetermined direction.

The step of moving the wiper by the wiper variable position unit according to another embodiment of the present invention comprises reciprocating a movable plate in a direction substantially perpendicular to a motion direction of the carriage, and moving a wiper slider adapted to support the wiper on an upper surface thereof and provided on one side of the movable plate. Movement of the wiper slider is along the motion direction of the carriage and is performed by a slider transfer unit.

The step of moving the slider transfer unit according to another embodiment of the present invention comprises exerting an attraction force on the slider transfer unit by a first elastic member with one end connected to one side of the wiper slider and with the other end connected to one side of the movable plate, exerting a repulsive force on a rack, the rack formed on a bottom surface of the wiper slider, via a second elastic member. The exerting is performed by a stopper adapted to be rotatably hinged on one side of the housing and having one end caught on the rack, and releasing the stopper from the rack by a moving unit.

The step of exerting an attraction force on the slider transfer unit by a first elastic member according to an embodiment of the present invention comprises exerting the attraction force on the slider transfer unit by a tension coil spring, and the step of exerting the repulsive force on the rack comprises exerting the repulsive force on the rack by a torsion spring having one end connected to the stopper and the other end connected to one side of the housing. The step of releasing the stopper by the moving unit comprises forcing the stopper to be momentarily released from the rack by an actuator, the actuator in contact with an actuating bar, wherein the actuating bar is adapted to integrally extend from the stopper.

The step of forcing the stopper to be momentarily released from the rack actuator according to an embodiment of the present invention comprises forcing the stopper to be momentarily released from the rack by a solenoid shaft.

The method for operating an ink jet printer according to another embodiment of the present invention further comprises shifting the wiper after a predetermined period of time.

The method for operating an ink jet printer according to still another embodiment of the present invention further comprises shifting the wiper after a predetermined number of print operations.

The method for operating an ink jet printer according to a further embodiment of the present invention further comprises shifting the wiper after a predetermined number of linear reciprocations.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Hereinafter, description will be made in more detail with regard to the configuration and operation of a print head cleaning apparatus according to an exemplary embodiment of the present invention with reference to FIGS. 2 to 5.

Figure 1:
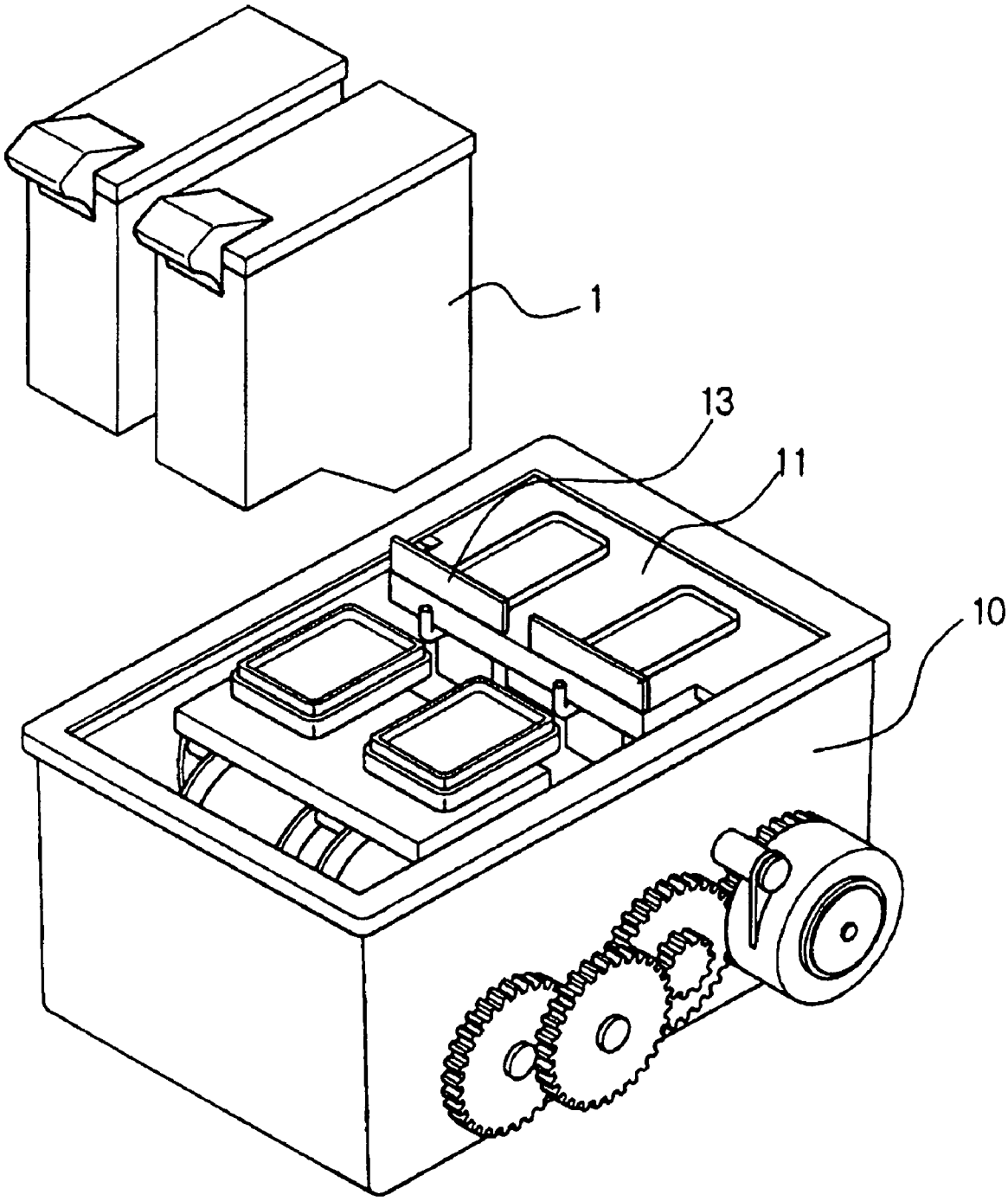
FIG. 1 (PRIOR ART)
FIG. 1 illustrates construction of a print head cleaning apparatus of a conventional ink jet printer.
Figure 2:
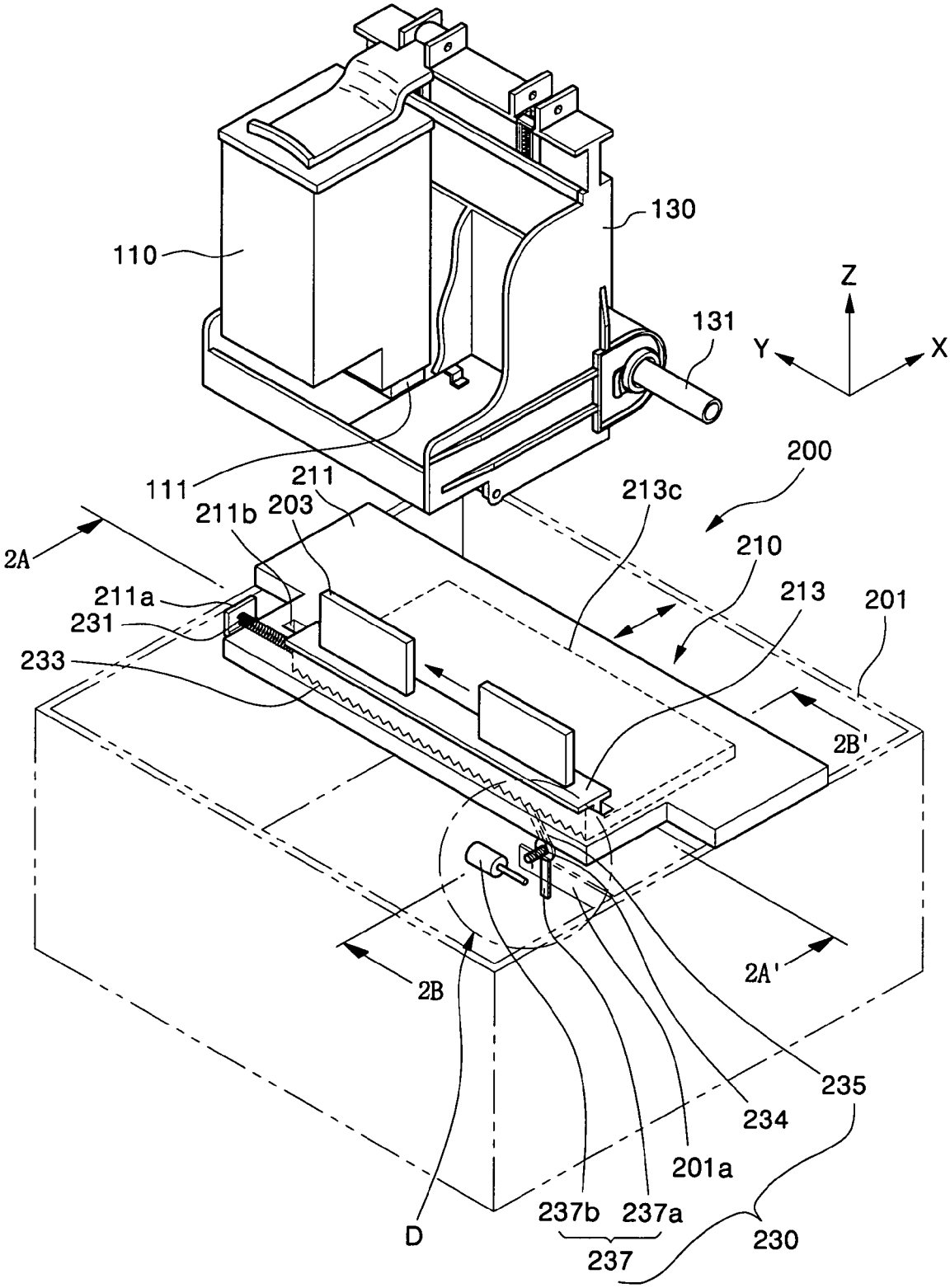
FIG. 2 illustrates construction of a print head cleaning apparatus of an ink jet printer according to an embodiment of the present invention.
Figure 3:
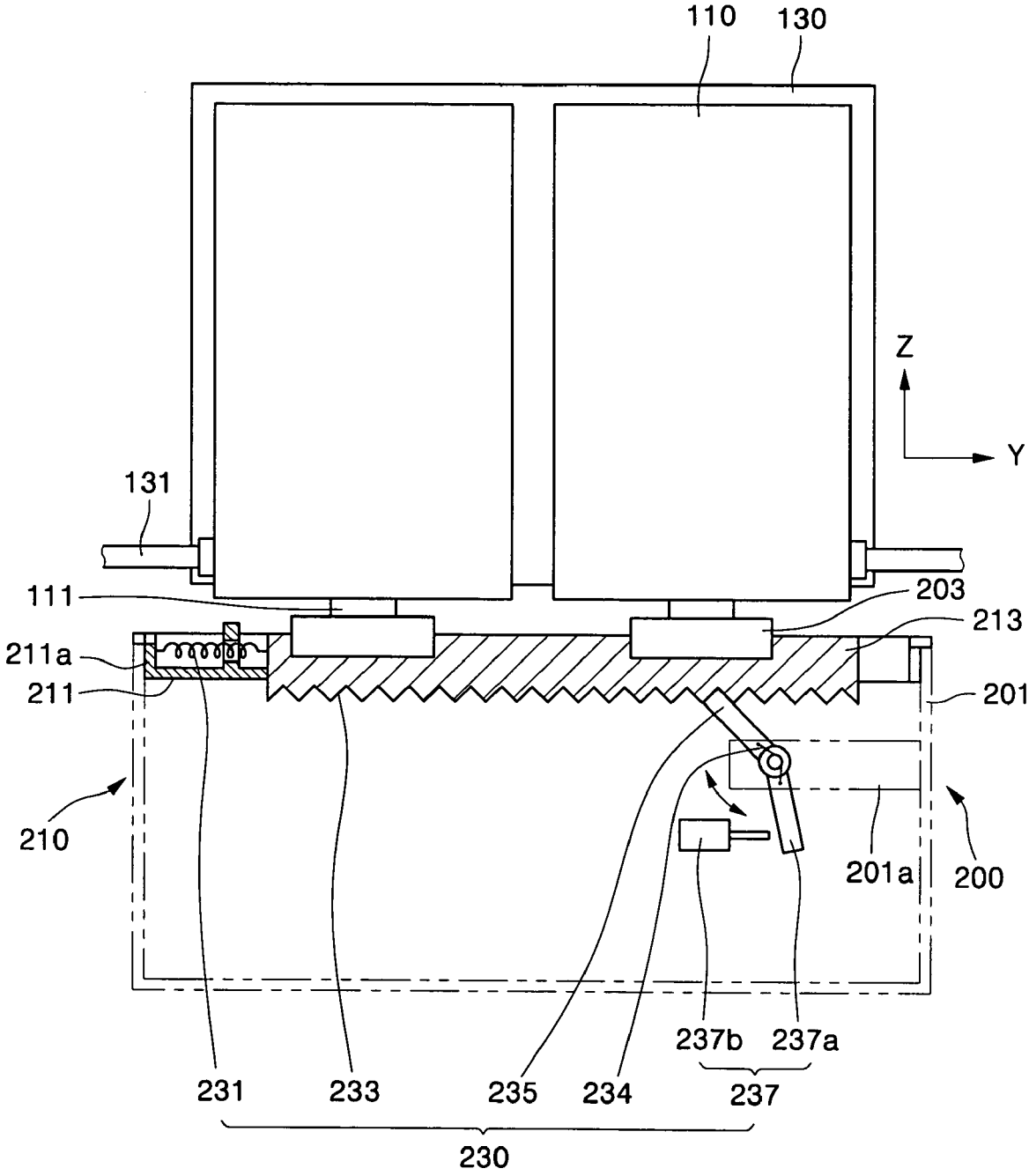
FIG. 3 is a cross-sectional view taken along the line 2A-2A' of FIG. 2.

As shown in FIG. 2, an ink jet printer is provided with an ink cartridge 110 on its lower side, wherein the ink cartridge 110 is provided with a print head 111 and is received in a carriage 130. The carriage 130 is installed to be capable of reciprocating along a guide shaft 131 in a Y-axis direction.

To prevent solidification of ink or introduction of foreign materials around a nozzle of the print head 111 in a printing standby state or a printer power-off state, a head cleaner 200 according to an embodiment of the present invention is provided on a service area.

The head cleaner 200 is generally composed of a housing 201, a wiper 203, and a wiper variable position unit 210.

The housing 201 is installed on the service area, and the wiper 203 is installed in the housing 201 and performs wiping in contact with the print head 111.

The wiper variable position unit 210 is also installed in the housing 201, and includes a movable plate 211 reciprocating in an X-axis direction, a wiper slider 213 provided on one side of the movable plate 211 and moving along a motion direction of the carriage 130 with the wiper 203 supported on the upper surface of the wiper slider, and a slider transfer unit 230 moving the wiper slider 213.

The slider transfer unit 230 includes a first elastic member 231 provided to exert an attraction force on the wiper slider 213 with one end connected to one side of the wiper slider 213 and with the other end connected to one side of the movable plate 211, a rack 233 formed on a bottom surface of the wiper slider 213, a stopper 235 rotatably hinged on one side of the housing 201 and having one end caught onto the rack 233 and coupled to exert a repulsive force on the rack 233 via a second elastic member 234, and a moving unit 237 releasing the stopper 235 from the rack 233.

In one exemplary embodiment, the first elastic member 231 is comprised of a tension coil spring. In order to fix the first elastic member 231, a fixing piece 211*a* is further provided on one side of the movable plate 211.

The second elastic member 234, in one embodiment of the present invention, makes use of a torsion spring. In this case, a separate bracket 201*a* is further provided on the inner surface of the housing 201 in order to fix the torsion spring 234, so that the torsion spring 234 is connected to the stopper 235 on one end thereof and fixed to the separate bracket 201*a* on the other end thereof.

Figure 4:
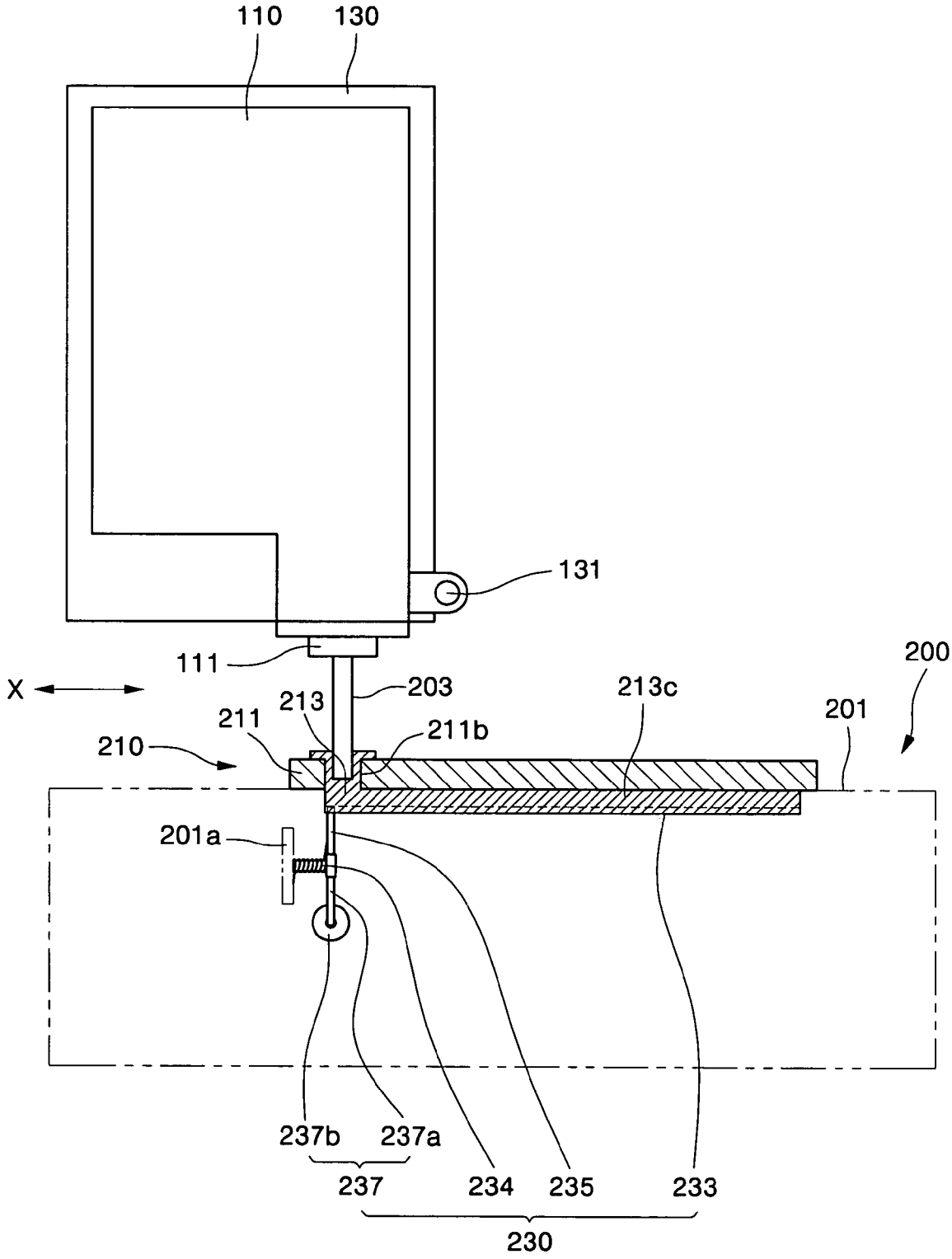
FIG. 4 is a cross-sectional view taken along the line 2B-2B' of FIG. 2.
Figure 5:
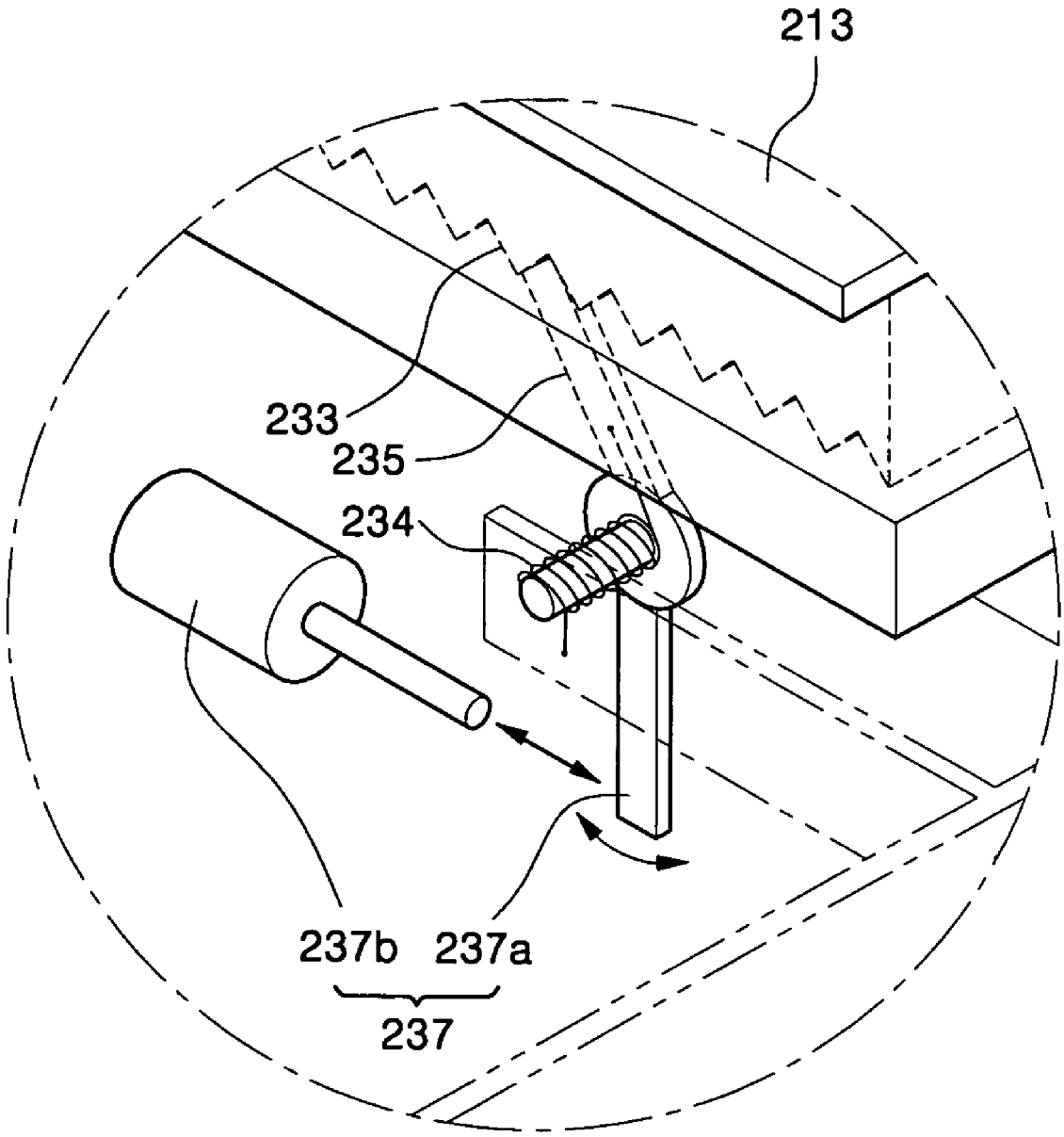
FIG. 5 is an enlarged view of the area D circled in FIG. 2.

The wiper slider 213, as shown in FIG. 4, is inserted into a sliding slot 211*b* of the movable plate 211 so that it can move in a Y-axis direction which is substantially perpendicular to the movable plate 211 (i.e., substantially perpendicular to the sheet of FIG. 4). In order to avoid interfering with the stopper 235 caught on the rack 233 when the movable plate 211 reciprocates in the X-axis direction, there is an extension 213*c* in contact with the bottom surface of the movable plate 211. In one embodiment of the present invention, a length of the extension 213*c* can be set in consideration of a movable length of the movable plate 211, and a bottom surface of the extension 213*c* is provided with the same profile as that of the rack 233.

The moving unit 237 includes an actuating bar 237*a* integrally extending from the stopper 235, and an actuator 237*b* forcing the stopper 235 to be released from the rack 233 in contact with the actuating bar 237*a*. In one embodiment of the present invention, the actuator 237*b* makes use of a solenoid shaft which is electrically driven. Further, the actuator 237*b* is periodically operated to move the wiper 203 for a predetermined period of time. The predetermined period of time refers to an interval which it takes the number of printed sheets of paper processed through the ink cartridge 110 to reach a predetermined number.

Operation of the print head cleaning apparatus constructed as set forth above will now be described in greater detail.

After completing a predetermined printing process, the ink cartridge 110 is transferred to a service area by the carriage 130. Then, the movable plate 211 installed in the housing 201 performs linear reciprocating movement in the X-axis direction, and thus comes into contact with the print head 111 provided on the bottom surface of the ink cartridge 110 to perform cleaning.

When the ink cartridge 110 processes the printing paper more than a predetermined number of times, an operation signal is transmitted to the actuator 237*b* or the solenoid shaft through a controller (not shown). The solenoid shaft 237*b* then pushes the actuating bar 237*a* (see FIG. 3), so that the stopper 235 engaged with one gear tooth of the rack 233 is released to the next gear tooth of the rack 233. Thereby, the stopper 235 is caught on the next gear tooth of the rack 233 (see FIG. 5).

Simultaneously, the tension spring 231 pulls the wiper slider 213 in the Y-axis direction, and thus the wiper slider 213 is shifted by one pitch. The solenoid shaft 237*b* does not continuously press the actuating bar 237*a*, but it only does so momentarily. As a result, the stopper 235 is caught on the next gear tooth of the rack 233 by the restoring force of the second elastic member 234, so that the wiper slider 213 is no longer shifted.

This operation causes the wiper 203 to move in a predetermined period of time.

In this manner, the wiper 203 changes its contact position with the nozzle portion of the print head 111 through the wiper variable position unit 210.

As can be seen from the foregoing, the invention is designed so that the wiper is capable of changing its contact position with the print head. Consequently, the drawback of abrasion taking place at a particular part of the wiper is substantially decreased, so that it is possible to enhance the wiping effect.

Although a preferred embodiment of the present invention has been described for illustrative purposes, it is apparent to those skilled in the art that various modifications, additions and substitutions are possible, without departing from the scope and spirit of the invention as disclosed in the accompanying claims.

What is claimed is:

1. An ink jet printer having an improved print head cleaning apparatus, comprising:

an ink cartridge provided with a print head on a lower portion thereof and adapted to perform linear reciprocating movement by a carriage;

a housing provided below a lower side of the carriage;

a wiper provided in the housing and adapted to contact and clean the print head; and a wiper variable position unit installed in the housing to move the wiper in a direction substantially perpendicular and in a direction substantially parallel to a moving direction of the ink cartridge.

2. The ink jet printer as claimed in claim 1, wherein the wiper variable position unit comprises:

a movable plate adapted to reciprocate in a direction substantially perpendicular to a motion direction of the carriage;

a wiper slider adapted to support the wiper on an upper surface thereof and provided on one side of the movable plate and further adapted to move along the motion direction of the carriage; and a slider transfer unit adapted to move the wiper slider.

3. The ink jet printer as claimed in claim 2, wherein the slider transfer unit comprises:

a first elastic member adapted to exert an attraction force on the slider transfer unit with one end connected to one side of the wiper slider and with the other end connected to one side of the movable plate;

a rack formed on a bottom surface of the wiper slider;

a stopper adapted to be rotatably hinged on one side of the housing and having one end caught on the rack and adapted to exert a repulsive force on the rack via a second elastic member; and a moving unit adapted to release the stopper from the rack.

4. The ink jet printer as claimed in claim 3, wherein the first elastic member is a tension coil spring.

5. The ink jet printer as claimed in claim 3, wherein the second elastic member is a torsion spring having one end connected to the stopper and the other end connected to one side of the housing.

6. The ink jet printer as claimed in claim 3, wherein the moving unit comprises:

an actuating bar adapted to integrally extend from the stopper; and an actuator adapted to force the stopper to be momentarily released from the rack in contact with the actuating bar.

7. The ink jet printer as claimed in claim 6, wherein the actuator is a solenoid shaft.

8. The ink jet printer as claimed in claim 1, wherein the wiper is shifted after a predetermined period of time.

9. A method of operating an ink jet printer having an improved print head cleaning apparatus, comprising:

moving an ink cartridge provided with a print head in a linear reciprocating manner in a predetermined direction with a carriage;

cleaning the print head by wiping a wiper in contact with the printhead in a direction perpendicular to the predetermined direction;

moving the wiper so as to change a contact position between the print head and the wiper; and moving the wiper in a direction parallel to the predetermined direction.

10. The method according to claim 9, wherein the step of moving the wiper so as to change the contact position between the print head and the wiper comprises:

moving the wiper by a wiper variable position unit.

11. The method for operating an ink jet printer as claimed in claim 9, wherein the step of moving the wiper by the wiper variable position unit comprises:

reciprocating a movable plate in a direction substantially perpendicular to a motion direction of the carriage;

moving a wiper slider adapted to support the wiper on an upper surface thereof and provided on one side of the movable plate, wherein the moving of the wiper slider is along the motion direction of the carriage; and moving the wiper slider by a slider transfer unit.

12. The method for operating the ink jet printer as claimed in claim 11, wherein the step of moving the slider transfer unit comprises:

exerting an attraction force on the slider transfer unit by a first elastic member with one end connected to one side of the wiper slider and with the other end connected to one side of the movable plate;

exerting a repulsive force on a rack, the rack formed on a bottom surface of the wiper slider, via a second elastic member, wherein the exerting is performed by a stopper adapted to be rotatably hinged on one side of the housing and having one end caught on the rack; and releasing the stopper from the rack by a moving unit.

13. The method for operating an ink jet printer as claimed in claim 12, wherein the step of exerting an attraction force on the slider transfer unit by the first elastic member comprises:

exerting the attraction force on the slider transfer unit by a tension coil spring.

14. The method for operating an ink jet printer as claimed in claim 12, wherein the step of exerting the repulsive force on the rack comprises:

exerting the repulsive force on the rack by a torsion spring having one end connected to the stopper and the other end connected to one side of the housing.

15. The method for operating an ink jet printer as claimed in claim 12, wherein the step of releasing the stopper by the moving unit comprises:

forcing the stopper to be momentarily released from the rack by an actuator, the actuator in contact with an actuating bar, wherein the actuating bar is adapted to integrally extend from the stopper.

16. The method for operating an ink jet printer as claimed in claim 15, wherein the step of forcing the stopper to be momentarily released from the rack actuator comprises:

forcing the stopper to be momentarily released from the rack by a solenoid shaft.

17. The method for operating an ink jet printer as claimed in claim 9, further comprising:

shifting the wiper after a predetermined period of time.

18. The method for operating an ink jet printer as claimed in claim 9, further comprising:

shifting the wiper after a predetermined number of print operations.

19. The method for operating an ink jet printer as claimed in claim 9, further comprising:

shifting the wiper after a predetermined number of linear reciprocations.

* * * * *